US011131429B2

(12) United States Patent
Bukkems et al.

(10) Patent No.: US 11,131,429 B2
(45) Date of Patent: Sep. 28, 2021

(54) SQUEEZED PROFILE TO SUPPORT LIGHTING

(71) Applicant: SIGNIFY HOLDING B.V., Eindhoven (NL)

(72) Inventors: Peter Johannes Martinus Bukkems, Deurne (NL); Winand Hendrik Anna Maria Friederichs, Elsloo (NL); Joris Jan Vrehen, Waalre (NL); Peter Rijskamp, Venray (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/961,621

(22) PCT Filed: Jan. 21, 2019

(86) PCT No.: PCT/EP2019/051331
§ 371 (c)(1),
(2) Date: Jul. 10, 2020

(87) PCT Pub. No.: WO2019/149551
PCT Pub. Date: Aug. 8, 2019

(65) Prior Publication Data

US 2020/0355328 A1 Nov. 12, 2020

(30) Foreign Application Priority Data

Feb. 1, 2018 (EP) ..... 1815406

(51) Int. Cl.
*F21K 9/232* (2016.01)
*F21S 8/08* (2006.01)
(Continued)

(52) U.S. Cl.
CPC ..... *F21K 9/232* (2016.08); *F21S 8/085* (2013.01); *F21V 29/503* (2015.01);
(Continued)

(58) Field of Classification Search
CPC ..... F21W 2131/103; F21S 8/085; F21S 8/086
See application file for complete search history.

(56) References Cited

U.S. PATENT DOCUMENTS 2,653,782 A * 9/1953 Pfaff, Jr. ..... E04H 12/24 248/219.1
4,639,843 A * 1/1987 Compton ..... F21S 8/086 362/431
6,340,790 B1 1/2002 Gordin et al.
(Continued)

FOREIGN PATENT DOCUMENTS

CN 205316198 U 3/2012
CN 203517379 U 4/2014
(Continued)

*Primary Examiner* — Alexander K Garlen
(74) *Attorney, Agent, or Firm* — Daniel J. Piotrowski

(57) ABSTRACT

The invention provides a lighting system (1) comprising a lighting unit (100) and a monolithic support element (200) for supporting the lighting unit (100), wherein the monolithic support element (200) comprises: —a support part (210) for supporting the lighting unit (100), wherein the support part (210) has a first length (L1), wherein the support part (210) has a support part outer shape and support part outer dimensions, wherein the support part (210) optionally includes a support part channel (211) over at least part of the first length (L1) having a first cross-sectional area (A1); —a first duct (220) having second length (L2), wherein the first duct (220) has a first duct outer shape and first duct outer dimensions, wherein the first duct (220) comprises a duct channel (221) over at least part of the second length (L2) having a second cross-sectional area (A2); —a transition part (230) bridging the support part (210) and the first duct (220); wherein one or mote of (i) the support part outer shape and the first duct outer shape differ, and (ii) the support part outer dimensions and the first duct outer dimensions differ.

17 Claims, 3 Drawing Sheets

(51) Int. Cl.
*F21V 29/503* (2015.01)
*F21Y 107/30* (2016.01)
*F21Y 115/10* (2016.01)
*F21W 131/103* (2006.01)

(52) U.S. Cl.
CPC .... *F21W 2131/103* (2013.01); *F21Y 2107/30* (2016.08); *F21Y 2115/10* (2016.08)

(56) References Cited

U.S. PATENT DOCUMENTS 7,278,761 B2* 10/2007 Kuan ..... F21S 8/086 362/294
8,430,532 B2* 4/2013 Lee ..... F21V 29/83 362/294
2008/0285265 A1* 11/2008 Boissevain ..... F21S 8/088 362/218
2010/0165615 A1* 7/2010 Aarts ..... F04F 7/00 362/227
2010/0214775 A1* 8/2010 Liang ..... F21V 23/02 362/184
2011/0176316 A1 7/2011 Phipps et al.
2011/0222284 A1* 9/2011 Kong ..... F21S 8/08 362/249.02
2012/0040585 A1 2/2012 Huang
2012/0320591 A1 12/2012 Liao et al.
2013/0088864 A1 4/2013 Verdes et al.
2015/0062911 A1* 3/2015 Winters ..... F21V 29/502 362/294
2018/0274771 A1* 9/2018 Zhang ..... F21V 29/70

FOREIGN PATENT DOCUMENTS

CN 103953880 B 5/2016
CN 202165996 U 6/2016
JP 2010118340 A 5/2010
KR 101076021 B1 11/2011
WO 2014033996 A1 3/2014
WO 2015058527 A1 4/2015

* cited by examiner

SQUEEZED PROFILE TO SUPPORT LIGHTING

CROSS-REFERENCE TO PRIOR APPLICATIONS

This application is the U.S. National Phase application under 35 U.S.C. §371 of International Application No. PCT/EP2019/051331, filed on Jan. 21, 2019, which claims the benefit of European Patent Application No. 18154706.8, filed on Feb. 1, 2018. These applications are hereby incorporated by reference herein.

FIELD OF THE INVENTION

The invention relates to a lighting system as well as to a method for making such lighting system. The invention also relates to a (monolithic) support element that can be used or made during such method.

BACKGROUND OF THE INVENTION

Street lamps, street poles, and street lamp fixtures are known in the art. US20130088864, for instance, describes a modular angled light engine, comprising: a center portion comprising an interlocking feature to connect to a second modular angled light engine; and at least one housing coupled to the center portion, wherein the at least one housing comprises: a heat sink coupled to a first side of the at least one housing; at least one light emitting diode (LED) coupled to an interior volume of the at least one housing; and a lens covering the at least one LED and coupled to a second side of the at least one housing.

US2012/040585 discloses a method of assembling an airtight LED light bulb which has the steps of: connecting a stem device with an LED device, drying the LED device, connecting the stem device with a bulb envelope, extracting air in the bulb envelope via a pipe, filling the bulb envelope with nitrogen or inert gas via the pipe, sealing an opening of the pipe which is located outside the bulb envelope to make the bulb envelope completely airtight and connecting a cap with the bulb envelope.

JP2010118340A discloses a light-emitting diode downlight which includes: a heat pipe; at least one light-emitting diode arranged on a pointed head and/or in the vicinity of a front end of an outer peripheral wall of the heat pipe; a plurality of heat dissipation plates arranged in the vicinity of an end of an outer peripheral wall of the heat pipe and expanding in diameter; a fixed member arranged on an end of the heat pipe and connected with the plurality of heat dissipation plates; a bulb having an opening, a housing space for housing the heat pipe, the light-emitting diode, the plurality of heat dissipation plates; and the fixed member, and a cover sealing the opening of the bulb and combined with the fixed member and electrically connected to the light-emitting diode.

WO2014033996A1 discloses a bulb-type lamp provided with: a globe; a support member disposed so as to extend from an opening part on the globe towards the inside of the globe; multiple LED chips supported by the support member; and a wavelength converter which is disposed within the globe along the direction in which the LED chips are arranged, has a predetermined shape, and is supported by the support member. The wavelength converter converts the wavelength of the light that was emitted from the LED chips to a predetermined wavelength by means of a converting material contained in the wavelength converter and emits the light of which the wavelength was converted.

CN203517379U discloses a lamp bulb based on inversely-installed LED chips and transparent ceramic substrates. The lamp bulb comprises a lampshade, a positive electrode contact, a lamp base, a heat conducting column, a radiating body, a positive electrode wire and a negative electrode wire, and is characterized in that connecting parts are arranged at the lower end of the heat conducting column, the transparent ceramic substrates are installed on the outer-side planes of the connecting parts, 10-80-degree angles are formed between the transparent ceramic substrates and the horizontal plane, the front faces of the transparent ceramic substrates are provided with circuit layers, the inversely-installed LED chips are packaged on the circuit layers, and the circuit layers are respectively connected with the positive electrode wire and the negative electrode wire. The connecting parts, the heat conducting column and the radiating body are of an integrated structure, so that the heat conducting effect is good; eutectic soldering is adopted for the transparent ceramic substrates and the connecting parts, so that installation is firm, and heat transmission is good.

US2011176316A1 discloses a lamp for general lighting applications. The lamp utilizes solid state light emitting sources to produce and distribute white light and dissipate the heat generated by the solid state light emitting sources. The lamp includes a thermal handling system having a heat sink and a thermal core made of a thermally conductive material to dissipate the heat generated by the solid state light emitting sources to a point outside the lamp.

SUMMARY OF THE INVENTION

There is a wide range of street lighting products. In order to improve standardization, a mutual platform for different type of street lighting products may be desirable. This may also apply for applications other than street lighting. Further, such mutual platform desirably has heat sinking properties, such that a solid state module can be applied to such platform.

Hence, it is an aspect of the invention to provide an alternative lighting system and/or method for making such lighting system, which preferably further at least partly obviates one or more of above-described drawbacks. The present invention may have as object to overcome or ameliorate at least one of the disadvantages of the prior art, or to provide a useful alternative. Further, it is an aspect of the invention to provide an alternative basis support element for a lighting unit, especially a solid state lighting unit, which preferably further at least partly obviates one or more of above-described drawbacks. The present invention may have as object to overcome or ameliorate at least one of the disadvantages of the prior art, or to provide a useful alternative.

Different techniques have been evaluated on their suitability. It especially appears that with a frame-based luminaire different designs are possible but in the same time technical challenges may be met.

In a first aspect, the invention provides a lighting system comprising a lighting unit and a support element, especially a monolithic support element, for supporting the lighting unit, wherein the (monolithic) support element comprises (especially consist of) a support part for supporting the lighting unit, wherein the support part has a first length L1, wherein the support part optionally includes a support part channel over at least part of the first length L1 having a first cross-sectional area A1; and a first duct ("duct") having second length L2, wherein the first duct comprises a duct channel over at least part of the second length L2 having a second cross-sectional area A2. Especially, in embodiments the support part has a support part outer shape and support part outer dimensions, the first duct has a first duct outer shape and first duct outer dimensions, wherein one or more of (i) the support part outer shape and the first duct outer shape differ, and (ii) the support part outer dimensions and the first duct outer dimensions differ. The first duct comprises electronics functionally coupled with the lighting unit. In this way an easy-to-install, low cost and/or late-stage configurable modular luminaire is obtained. The reason is that the lighting system can be functionally (mechanically and/or electrically) coupled to a pole e.g. of a luminaire e.g. a streetlight luminaire/fixture. Further, the obtained effect is improved standardization/an improved mutual platform. The reason is that a mutual platform for different types of luminaires such as for example street lighting products is obtained, because the (monolithic) support element comprises the electronics. Suggested configuration also enables that the electronics are arranged at a short distance to the lighting unit preventing/reducing issues with respect to safety and/or reliability. In specific embodiments, when the support part comprises the support element channel, then a ratio of the first cross-sectional area A1 to the second cross-sectional area A2 is in specific embodiments equal to or smaller than 0.8, such as equal to or smaller than 0.5, like in specific embodiments equal to or smaller than 0.2. Hence, especially the invention provides (in an aspect) a lighting system comprising a lighting unit and a monolithic support element, for supporting the lighting unit, wherein the monolithic support element comprises (especially consist of) a support part for supporting the lighting unit and a first duct, wherein the outer dimensions and/or the shape of the support part differ from the first duct (even though the support element is a monolithic element). Especially, in embodiments the duct may have a circular outer shape, whereas the support part may include a flat (or planar) (outer) face for supporting the lighting unit.

Such support element may be relatively easily made, and may also be custom made. For instance, an angle between the support part and the duct may be created, when desired. Further, the support element may be of a thermally conductive material, such as a metal. The thermally conductive material and/or another material may also be used to close the support element (at one end) (as the first channel may be closed). For instance, the thermally conductive material and/or another material may be used as an IP seal. For instance, in embodiment a thermal conductive glue may be used (to bridge the air gap, essentially defined by the support element channel).

Yet further, the support part may be used to support the lighting unit and the duct may be used to host electronics. The support element may even be created in an existing pole or tube, such as by pinching part thereof to create the support part. Instead of the term "pinch" and similar terms, also the term "squeeze" and similar terms may be applied.

As indicated above, the lighting system comprising a lighting unit. The lighting unit may include one or more light sources. The term "light source" may refer to a semiconductor light-emitting device, such as a light emitting diode (LEDs), a resonant cavity light emitting diode (RCLED), a vertical cavity laser diode (VCSELs), an edge emitting laser, etc. The term "light source" may also refer to an organic light-emitting diode, such as a passive-matrix (PMOLED) or an active-matrix (AMOLED). In a specific embodiment, the light source comprises a solid state light source (such as a LED or laser diode). In an embodiment, the light source comprises a LED (light emitting diode). The term LED may also refer to a plurality of LEDs. Further, the term "light source" may in embodiments also refer to a so-called chips-on-board (COB) light source. The term "COB" especially refers to LED chips in the form of a semiconductor chip that is neither encased nor connected but directly mounted onto a substrate, such as a PCB. Hence, a plurality of semiconductor light sources may be configured on the same substrate. In embodiments, a COB is a multi LED chip configured together as a single lighting module. The term "light source" may also relate to a plurality of light sources, such as 2-2000 solid state light sources. Hence, the term "light source" especially refers to one or more solid state light sources, such as one or more LEDs.

Especially, the lighting unit may be an integral unit, ready for use, such as for outdoor use. Further, especially the lighting unit includes one or more elements allowing the lighting unit to be fixed to a support, such as herein especially the support element. Such one or more elements may include one or more of a rail, or a host for a rail, a screw or bolt, a thread for a screw or a nut for a bolt, etc. etc. Alternatively or additionally, also a glue may be applied, such as a thermally conductive glue. Also with such glue, the lighting unit may be fixed to the support.

Hence, the lighting unit may include a closed housing, such as an IP66 (or higher) housing, including one or more (solid state) light sources.

Further, the lighting system includes a support element, especially a monolithic support element, for supporting the lighting unit. Herein, the support element is further explained in relation to the monolithic support element. Herein, the terms "monolith" or "monolithic" and similar terms may refer to cast as a single piece or formed or composed of material without joints or seams. Especially, the terms "monolith" or "monolithic" and similar terms refer to being composed of material without joints or seams. For instance, part of a duct (herein also indicated as "starting duct") may be pinched, to provide a duct with a support part. Therefore, especially the support part comprises a pinched part of the duct.

The starting duct may have a channel having a circular cross-section. However, other types of cross-section may also be possible, such as square, rectangular, hexagonal, etc. The channel may have an equivalent circular diameter selected from the range of 1-50 cm, especially in the range of 1.5-25 cm, like 1.5-20 cm. The equivalent circular diameter (or ECD) of an irregularly shaped two-dimensional shape is the diameter of a circle of equivalent area. For instance, the equivalent circular diameter of a square with side a is $2*a*SQRT(1/\pi)$. In some specific embodiments, however, a ratio of the first cross-sectional area A1 to the second cross-sectional area A2 may be equal to or larger than 1, such as in the range of 1-1.2, especially in the range of 1-1.1. Dependent upon the type of deformation, the ratio can be smaller than 1, can be equal to 1 or can be larger than 1. Especially, however, the deformation may lead to ratios smaller than 1.

The support part has a first length L1. Dependent upon the type of application, this may e.g. be from 1 cm to 4 m, though longer may also be possible. For instance in the case of street lighting with e.g. poles, this may even be longer than 4 m, as in embodiments the pole may be applied as support element. In general, for many applications this length may be in the range of 2-80 cm.

As the support part may be a pinched part of a duct, the channel size of the original duct channel may be very small.

Even, the pinching may be such that originally oppositely arranged wall parts now touch. When the original duct channel is not completely removed by the pinching, such remaining channel may be filled with a liquid or solid material, such as a thermally conductive material. Therefore, in embodiments the support part includes the support part channel, and the support part channel is filled with a thermally conductive material. The remaining channel in the support part, i.e. the support part channel, may e.g. be filled with one or more of a rubber material, a thermal paste, silicone, carbon sheets, a (thermally conductive) metal. Further, as indicated above, a (thermally conductive) glue may be applied.

Alternatively, in embodiments the support part comprises two wall parts of a wall, wherein the wall parts are configured parallel and touch each other. In such embodiments, the pinching has continued until the originally oppositely arranged wall parts touch.

Hence, the support part optionally includes a support part channel over at least part of the first length L1 having a first cross-sectional area A1.

As indicated above, the first duct has second length L2. Dependent upon the type of application, this may e.g. be from 1 cm to 2 m, though longer may also be possible. In general, this length may be in the range of 2-100 cm. The first duct comprises a duct channel over at least part of the second length L2 has a second cross-sectional area A2. This first cross-sectional area will especially be smaller than the first cross-sectional area. The second cross-sectional area may especially be defined perpendicular to a duct channel axis. The first cross-sectional area may especially be defined relative to a plane of the support part to which the lighting unit may be associated.

As indicated above, the first cross-sectional area of the channel in the support part is smaller than of the duct channel. Especially, when the support part comprises the support element channel, then a ratio of the first cross-sectional area A1 to the second cross-sectional area A2 is equal to or smaller than 0.2, such as at maximum 0.1. Especially, $0 \leq A1/A2 \leq 0.8$. The condition of $A1/A2=0$ may apply to a starting duct where part of the duct is completely pinched. However, the invention is not necessarily limited to pinched ducts. The support element may also be obtained via other routes, such as casting. molding, extrusion, rolling, etc. However, especially a pinching method may be applied (see also below).

As indicated above, one or more of (i) the support part outer shape and the first duct outer shape differ, and (ii) the support part outer dimensions and the first duct outer dimensions differ.

Herein, the terms "support part outer shape" and "first duct outer shape" especially refer to outer shape or external face of the respective parts of the support element. Further, these shapes may thus also refer to the outer shapes of cross-sections perpendicular to axis of elongation of such respective part. The outer shape of the starting duct may in embodiments be selected from circular, oval, triangular, square, rectangular, or any (other) polygonal with three or more sides, especially regular polygonals with flat sides. For instance, a tube with a circular outer shape (cross-section) may be applied as starting duct. In such embodiments, especially the first duct outer shape will be circular. However, also a tube with a square or hexagonal outer shape (cross-section) may be applied. By deformation, such as by applying a force, like compression, and/or applying heat, part of the starting duct may be deformed to provide the deformed part another outer shape. In embodiments, the starting duct may be circular, and the support part may have a plate-like shape (essentially full compression) or triangular, square, rectangular, or any (other) polygonal with three or more sides, especially regular polygonals with flat sides.

The terms "support part outer shape" and "first duct outer shape" especially refer the general outer shape of the respective part. Especially the support part outer shape may include features for facilitating the support of the lighting unit. For instance, one or more of a mounting feature, like a guide rail or a bump to lock the lighting unit or a lighting unit (or a cover thereof) on the support part. During or after the deformation process, especially during the deformation process, one or more of holes, louvers, protruding parts ("bumps", other small deformations, may be introduced in the support part (and other parts as well). Also part of the material may be removed, such as for including a hole. For instance, a guide rail may be provided, during deformation, to hold the lighting (cap). A through put wire may be introduced, which may be useful in view of e.g. IP66 (or higher) conditions. A protruding part (less deformation), may provide a flattened section for orienting the lighting unit. Holes, rails, protruding parts may be configured to click connect the lighting unit (cap) and/or for creating a defined sealing line and or click position. As indicated above, a plurality of such features may be provided, especially during the deformation process. Further, the support element, and in embodiments especially the support part, may also include one or more fins. Such fins may be useful for distribution of heat, and thereby facilitating cooling the lighting unit during use. Also fins may be generated by squeezing or pinching the (starting) duct.

Hence, the entire support part is not necessarily flat, but especially includes one or more flat faces or sections.

Herein, the terms "support part outer dimensions" and the "first duct outer dimensions" especially refer to dimensions selected from width, height, and diameter of the respective parts of the support element. These terms may also refer to cross-sectional of lengths of sides and mutual angles of sides of the respective support parts. For instance, would a support part have a hexagonal cross-section or outer shape, then the mutual angles of the six sides are 60°. In general, the support part outer shape and the first duct outer shape will each independently be symmetrical.

Hence, the (monolithic) support element comprises a support part for supporting the lighting unit. The support part may include a face for configuring the lighting unit or a plurality of lighting units. The support part may also include a plurality of faces for configuring a plurality of lighting units. With the method as described herein (see also below), it is relatively easy to customize the length, the width, an angle relative to the duct, etc. This may allow a large freedom in terms of one or more of scaling and tailoring to the specific application position. For instance, by choosing the angle also the direction of the optical axis of the lighting unit may be chosen.

Therefore, in embodiments the duct channel has a channel axis, wherein the support part and the channel axis are configured parallel. For instance, this may be achieved when pinching the starting duct, without bending. In alternative embodiments, the duct channel has a channel axis, wherein the support part and the channel axis are configured non-parallel.

Hence, the invention allows providing a support element, especially a monolithic support element, wherein the support element may have one or more support parts, and wherein the support parts may be flat, may be curved, may include facets and/or wherein the support element may include a plurality of support parts. Hence, the present invention allows a large tailing of the lighting system dedicated to a position where the lighting system is to be used. In specific embodiments, the support part comprises a flat face for supporting the lighting unit. As can be retrieved from the above, the terms "support part" or "face" may also refer to a plurality of support parts or a plurality of faces, respectively.

For instance, when a pinching method is applied, but also in other methods for creating the support element, the creation of the support part, such as from a starting duct, may also imply that a transition part is created between an essentially unchanged part of the starting duct and the pinched part of the starting duct.

Hence, especially the support element further comprises a transition part bridging the support part and the first duct. This can be seen as a deformed part wherein the cross-sectional area reduced along the length of the support element from the duct to the support part. Hence, in embodiments the transition part may define a gradual change from the first duct outer shape to the support part outer shape. Thus, especially there may be a (relative) smooth transition in the outer shape from the support part and the first duct.

The transition part can be used for transit of an electrical cable from the lighting unit to e.g. electronics, such as e.g. configured in the duct (see also below). The term "cable" may also refer to a plurality of different cables. The cable may be configured via the support part channel of the support part. In such embodiments, the transition part may also be hollow. In other embodiments, wherein there is essentially no support part channel, or the support part channel has such small dimensions, that a cable cannot be fed there through, the transition part can be hollow or can be closed. Also part of the transition element can be hollow and part can be closed.

Would the support part and/or the transition part does not have remaining channel with dimensions suitable for a cable, a channel may be created through the transition part. This may be done during the method of producing of the lighting system (or the method of producing the support element).

Hence, in embodiments the transition part comprises a cable transit for transit of an electrical cable for a functional coupling to the lighting unit, and wherein the first duct comprises electronics functionally coupled with the lighting unit.

It may be especially useful when the support element comprises a metal, such as an aluminum support element. Therefore, in specific embodiments the monolithic support element comprises a metal. In alternative embodiments, the monolithic support element comprises a polymeric material, especially thermoplastic material.

In embodiments, the (monolithic) support element may thus comprise the support part and the duct. In embodiments the support element (essentially) consists of the support part and the duct. In embodiments, the (monolithic) support element may thus comprise the support part, the transition part, and the duct. In embodiments the support element (essentially) consists of the support part, the transition part, and the duct.

In yet a further aspect, the invention also provides a support element, especially a monolithic support element comprising a support part (for supporting a lighting unit), wherein the support part has a first length L1, wherein the support part optionally includes a support part channel over at least part of the first length L1 having a first cross-sectional area A1, a first duct having second length L2, wherein the first duct comprises a duct channel over at least part of the second length L2 having a second cross-sectional area A2, and a transition part bridging the support part and the first duct. Especially, one or more of (i) the support part outer shape and the first duct outer shape differ, and (ii) the support part outer dimensions and the first duct outer dimensions differ.

In specific embodiments, the support part comprises the support element channel; in such embodiments the ratio of the first cross-sectional area A1 to the second cross-sectional area A2 is equal to or smaller than 0.8, such as equal to or smaller than 0.5, like equal to or smaller than 0.2. In other embodiments, the first cross-sectional area has such small dimensions that the support element channel is essentially absent. In specific embodiments, this support element channel is not available (i.e. A/A2=0). Therefore, when the support part comprises the support element channel, then a ratio of the first cross-sectional area A1 to the second cross-sectional area A2 is equal to or smaller than 0.8, such as equal to or smaller than 0.5, such as equal to or smaller than 0.2. In other embodiments, the ratio may be larger than 1 (see also elsewhere).

Embodiments as described above in relation to the lighting system may also apply to the support element per se, especially those embodiments that relate to one or more features of the (monolithic) support element. A few (of those) embodiments are however explicitly indicated below; for those not mentioned explicitly below, it is referred to the embodiments described elsewhere herein (especially above).

In embodiments, the support part comprises a pinched part of the duct. Further, in embodiments the duct channel has a channel axis, wherein the support part and the channel axis are configured parallel. However, in embodiments it may also be possible that the duct channel has a channel axis, wherein the support part and the channel axis are configured non-parallel. Especially, in embodiments the support part comprises a flat face for supporting the lighting unit. Hence, the support part may be a flat face or may comprise a flat face. The support part may also include a plurality of flat faces. A flat face may have an area of at least about 1 $cm^2$, such as at least about 2 $cm^2$, like at least about 4 $cm^2$, such as in the range of 2-400 $cm^2$. Preferably, the flat face has an area of at least 25 $cm^2$, more preferably at least 30 $cm^2$, most preferably at least 35 $cm^2$. The lighting unit has preferably a bottom area of at least 25 $cm^2$, more preferably at least 30 $cm^2$, most preferably at least 35 $cm^2$. The flat area may be larger than the bottom area of the light unit. The bottom area of the lighting unit may be completely covered by the flat area of the support part. In specific embodiments, two (of two or more flat faces) may be configured parallel at two different sides of the support part. In further specific embodiments, two (of two or more flat faces) may be configured under an angle larger than 0° and smaller than 180°.

Further, in embodiments the support part includes the support part channel, and wherein the support part channel is filled with a thermally conductive material. However, in other embodiments the support part comprises two wall parts of a wall, wherein the wall parts are configured parallel and touch each other.

In embodiments, the transition part comprises a cable transit for transit of an electrical cable for a functional coupling to the lighting unit, and wherein the first duct comprises electronics functionally coupled with the lighting unit.

In embodiments, the support part channel may host an electrical cable. In yet other embodiments, the support part channel is over at least part of its length essentially occupied with the electrical cable. In embodiments, the support part channel is filled over at least part of its length with a filler material and an electrical cable, thereby closing the support part channel, such as for an IP66 or higher closure. The filler may e.g. comprise a glue or adhesive. When an electrical cable is hosted in the support part channel, the electrical cable may especially have been introduced after the deformation of the monolithic support.

In embodiments, the lighting unit is arranged on the outer surface of the support part.

In embodiments, the support part comprises a flat face for supporting the lighting unit, wherein the lighting unit is arranged on the outer surface of a flattened area.

In embodiments, the lighting unit (or lighting units) is asymmetrically arranged with respect to the channel axis.

Further, as indicated above, in specific embodiments the monolithic support element comprises a metal.

In yet a further aspect, the invention also provides pole comprising the lighting system as defined herein, or the lighting system obtainable with the method as defined herein (see also below). For instance, pole as such may be used to create the support element. However, it is also possible to provide poles dedicated to specific ducts, wherein the pole and the duct of the support element can functionally be coupled. For example, a luminaire may comprise the lighting system and one or more poles which can be mechanically and/or electrically coupled. For example, a luminaire pole can be slided in the first duct and/or the first duct can be slided in the luminaire pole. Sub sequentially, this joint configuration may be locked by e.g. deforming luminaire pole, second duct or the first duct at the slided area. In an alternative screws, pins, clamps and the like may be used.

Applications may e.g. include poles, trunking, home lighting chandeliers, standing lights, etc. Trunking may especially refer to creating an intermediate support part, with (first) ducts at both sides.

In yet a further aspect, the invention also provides a method of making a lighting system, the method comprising: providing a starting duct having a third length L3, wherein the starting duct comprises a duct channel over at least part of the third length L3 having a second cross-sectional area A2 and compressing the starting duct over part of the third length L3 together, until over part of the third length L3 the duct channel has a cross-sectional area A1 in compliance with a ratio of the first cross-sectional area A1 to the second cross-sectional area A2 of $0 \leq A1/A2 \leq 0.8$, such as $0 \leq A1/A2 \leq 0.5$, thereby providing a support part (and a transition part bridging the support part and the remainder of the starting duct), and functionally coupling the lighting system to the support part.

Further, the support part may be created at an end of the starting duct. Hence, the support part may be configured at an end of a duct. However, alternatively the support part may be configured between two first duct parts, which may have equal or which may have different lengths. In such embodiment, there may be a single support part and two transition parts. Yet further, in embodiments the support element may also include a plurality, such as two support parts. In embodiments, these support parts may be created in a single deformation stage, though in other embodiments, these support parts may be created in sequential deformation stages. When there are two support parts, these may be configured at end positions of the first duct. However, one or more of a plurality of support parts may also be configured at non-end positions along the duct.

In specific embodiments, especially $0 \leq A1/A2 \leq 0.1$. This may be beneficial in view of transfer of thermal energy. Even more especially, $0 \leq A1/A2 \leq 0.05$. As indicated above, in embodiments $A1/A2=0$; i.e. the duct is forced such that opposite parts of the former duct touch each other and there is essentially no duct channel in the support part.

The support element may thus also be useful in view of heat sinking aspects, especially when the support part includes e.g. one or more fins and/or when the support element includes a metal. Hence, the support part may be used to guide away heat from the lighting unit.

In yet a further aspect, the invention also provides the method of making the support element, especially the monolithic support element, per se. Hence, the invention (thus) also provides in yet a further aspect a method of making a (monolithic) support element, the method comprising: providing a starting duct having a third length L3, wherein the starting duct comprises a duct channel over at least part of the third length L3 having a second cross-sectional area A2 and deforming, such as compressing, the starting duct over part of the third length L3 (together). Hence, in embodiments the method may thereby provide a support part and a transition part bridging the support part and the remainder of the starting duct (i.e. the essentially non-deformed part), wherein one or more of (i) a support part outer shape and a first duct outer shape differ, and (ii) support part outer dimensions and first duct outer dimensions differ. Further, in embodiments the method may include deforming the starting duct over part of the third length L3 until over part of the third length L3 the duct channel has a cross-sectional area A1 in compliance with a ratio of the first cross-sectional area A1 to the second cross-sectional area A2 of in specific embodiments $0 \leq A1/A2 \leq 0.8$, such as $0 \leq A1/A2 \leq 0.5$, thereby providing a support part (and a transition part bridging the support part and the remainder of the starting duct). Especially, the method may include deforming such that a flat face is obtained. In specific embodiments, the starting duct especially comprises a circular outer shape. Hence, in specific embodiments the first duct outer shape may be circular.

As indicated above, the term "flat face" may also refer to a plurality of flat faces. Further, the support part may additionally or alternatively also included features for facilitating attachment of the lighting unit (cap) to the support part. Further, the support part may also be used to support a plurality of lighting units, such as in embodiments at different flat faces of the support part.

Such (monolithic) support element may be used to support one or more lighting units. Therefore, the method may further include functionally coupling the lighting system to the support part. In general, the functional coupling, such as attaching, of the lighting units to the support part will be executed after the support part has been created.

The stage of deforming the starting duct over part of the third length L3 together may thus especially include a pinching stage. Therefore, the stage of compressing the starting duct over part of the third length L3 together may thus especially include a pinching stage. Further, the part of the third length L3 over which the starting duct is compressed may essentially provide the support part with the first length.

The stage of deforming may optionally include a heating, such as a local heating of the starting duct. For instance, a pinching apparatus may be applied with one or more heated elements that are also used for pinching.

Note that the invention is not limited to pinching. However, the pinching of a starting duct appears to be a very useful way to obtain the support element, especially the monolithic support element.

As indicated above, when creating the support part, also a transition part may be created. In further embodiments, the method may comprise creating a cable transit in the transition part, guiding an electrical cable through the cable transit, wherein the electrical cable is functionally coupled to the lighting system. For instance, during a pinching stage or after a pinching stage, such cable transit may be created. In embodiments, a pinching apparatus may be applied that is configured to pinch the starting duct and configured to create the cable transit in the transition part. As indicated above, especially the starting duct comprises a metal. Suitable metals, such as aluminum, may relatively easily be pinched. However, also plastics as support material may be used.

Further, the lighting device is functionally coupled with electronics. The term "electronics" may amongst others refer to one or more of a ballast, an electrical power device, a control system, etc., especially at least one or more of a ballast and an electrical power device. An excellent position for the electronics is in the remainder of the starting duct, i.e. the first duct. Therefore, the method further comprises introducing electronics in at least part of the remainder of the starting duct, and functionally coupling the electronics with the lighting unit. In this way an easy-to-install, low cost and/or late-stage configurable modular luminaire is obtained. The reason is that the lighting system can be functionally (mechanically and/or electrically) coupled to a pole of e.g. a luminaire e.g. a streetlight luminaire/fixture. Further, the obtained effect is improved standardization/an improved mutual platform. The reason is that a mutual platform for different types of luminaires such as for example street lighting products is obtained, because the (monolithic) support element comprises the electronics. Suggested configuration also enables that the electronics are arranged at a short distance to the lighting unit preventing/reducing issues with respect to safety and/or reliability. In embodiments, the electronics may be available before the support part is created. Then, after creating the support part, the functional coupling may be realized. In other embodiments, the electronics are introduced in the first duct after the support part is created. After creating the support part, also the functional coupling may be realized.

Hence, the method may include a stage wherein after deformation the lighting unit is functionally coupled and one or more of an electrical cable and electronics are introduced in the support element. The electrical cable may already be functionally coupled to the lighting unit before functionally coupling of the lighting unit to the support element. Hence, the method may thus include a stage wherein after deformation the lighting unit is functionally coupled to the support element and an electrical cable, and optionally electronics, is (are) introduced in the support element. The term "electrical cable" may also refer to a plurality of electrical cables.

As indicated above, the method may also include deforming until over part of the third length L3 the duct channel has a cross-sectional area A1 in compliance with a ratio of the first cross-sectional area A1 to the second cross-sectional area A2 in the range of $0 \leq A1/A2 \leq 0.1$. This may be beneficial in view of transfer of thermal energy. Even more especially, $0 \leq A1/A2 \leq 0.05$. As indicated above, in embodiments $A1/A2=0$; i.e. the duct is forced such that opposite parts of the former duct touch each other and there is essentially no duct channel in the support part.

The lighting device may be part of or may be applied in e.g. office lighting systems, household application systems, shop lighting systems, home lighting systems, accent lighting systems, spot lighting systems, theater lighting systems, projection systems, warning sign systems, medical lighting application systems, indicator sign systems, decorative lighting systems, portable systems, automotive applications, (outdoor) road lighting systems, urban lighting systems, green house lighting systems, horticulture lighting, etc.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
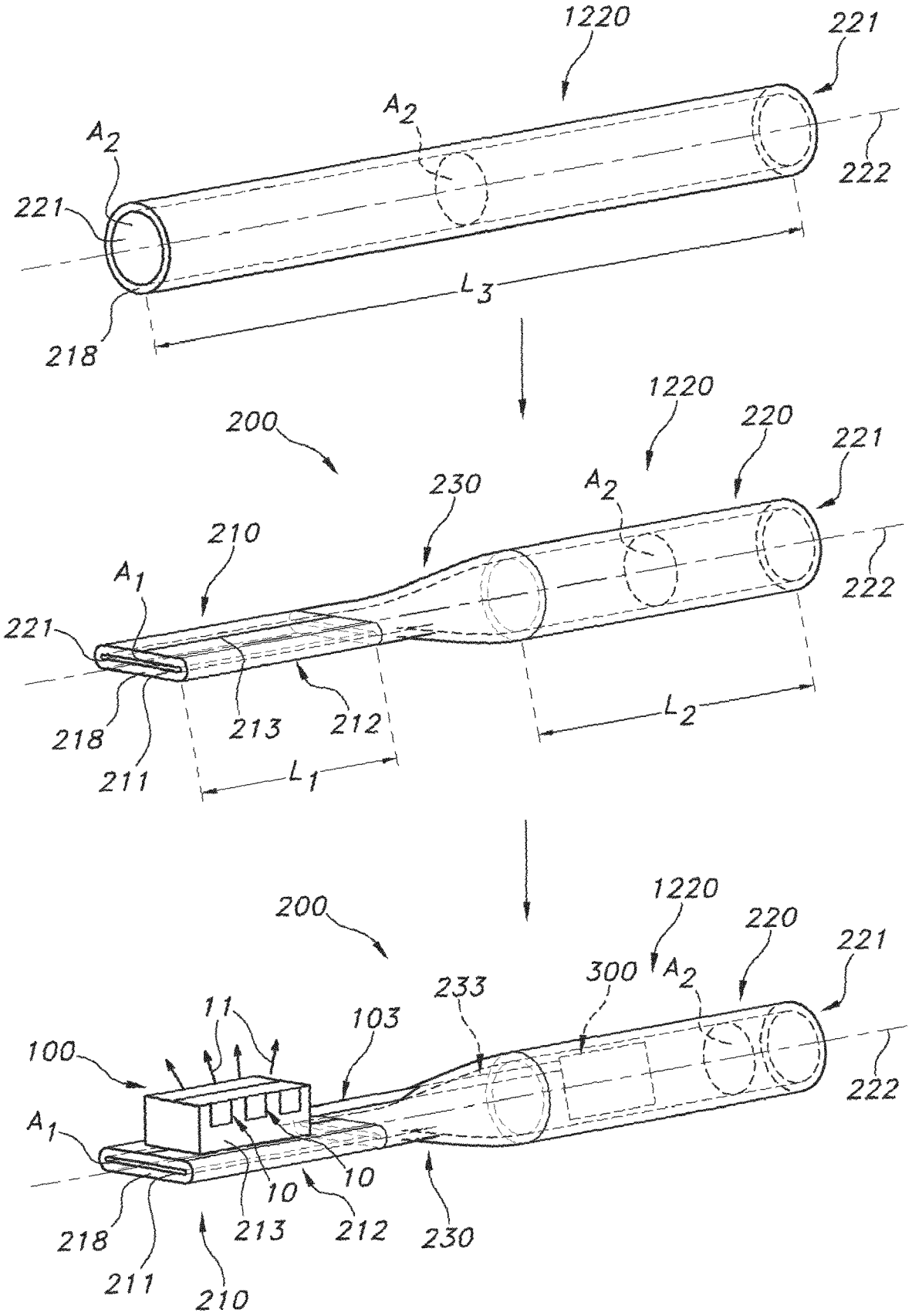
FIG. 1 schematically depicts an embodiment of a method of making the support element and/or the lighting system.

FIG. 1 schematically depicts an embodiment of a method of making a support element 200 and/or a lighting system 1. The method of making comprises providing a starting duct 1220 having a third length L3. The starting duct 1220 may be of metal. The term "starting duct" is applied, as a duct may be used to start with and transform into the support element 200 and lighting system, respectively. The starting duct is monolithic.

The starting duct 1220 comprises a duct channel 221 over at least part of the third length L3. This duct channel 221 has a second cross-sectional area A2.

To provide the support part, which may e.g. support a lighting unit 100, in embodiments the starting duct 1220 over part of the third length L3 together, until over part of the third length L3 the duct channel 221 has a cross-sectional area A1 in compliance with a ratio of the first cross-sectional area A1 to the second cross-sectional area A2 of $0 \leq A1/A2 \leq 0.8$. In this way the support part 210 is provided. Further, also a transition part 230 bridging the support part 210 and the remainder of the starting duct 1220 may be provided. The remainder of the starting duct is herein also indicated as duct or first duct 220. Note that the first cross-sectional area may practically be zero (square centimeter). This implies that the wall of the (starting) duct, which is indicated with reference 218, is compressed to such an extent that wall parts that were opposite of each other before compression, now touch each other.

Hence, in this way the support element 200 is provided. As shown, the support part 210 may thus comprise a pinched part 212 of the duct 210. Further, as shown in FIG. 1, the support part 210 comprises a flat face 213 for supporting the lighting unit 100; a plurality of such faces may be available. Instead of the terms "face" or "flat face" also the terms "section" or "flat section" may be applied. The flatness may especially be macroscopic, as known to a person skilled in the art, allowing a lighting unit to be supported by the support part.

After producing the support element 200, the lighting system 1 may functionally be coupled to the support part 210, e.g. with screws, in a tray, etc. etc. Reference 10 indicates a light source, such as a solid state light source, and reference 11 indicates light source light. The solid state light source may comprise optics to redirect e.g. collimate the light source light. The light source light 11 may have a major light direction perpendicular to the flat surface. The light source light 11 may have a major light direction non perpendicular to the channel axis 222.

FIG. 1 thus also shows an embodiment of a (monolithic) support element 200. This support element 200 comprises a support part 210 for supporting a lighting unit 100, wherein the support part 210 has a first length L1, wherein the support part 210 optionally includes a support part channel 211 over at least part of the first length L1 having a first cross-sectional area A1. Further, the support element 200 comprises the first duct 220 having second length L2, wherein the first duct 220 comprises the duct channel 221 over at least part of the second length L2 having the second cross-sectional area A2. Yet further, the support element 200 comprises the transition part 230 bridging the support part 210 and the first duct 220.

In the lowest part of FIG. 1, A1 is practically zero (square centimeter). With respect to such embodiments, one can indicate that the support part includes a support part channel with a first cross-sectional area A1 of (essentially) zero (square centimeter) or one can indicate that there is no support part channel, as the first cross-sectional area A1 is (essentially) zero (square centimeter).

FIG. 1 also schematically depicts an embodiment wherein the starting duct comprises a circular outer shape. The first duct outer shape is here (thus) also circular.

The method may also include creating a cable transit 233 in the transition part 230, guiding an electrical cable 103 through the cable transit 233, wherein the electrical cable 103 is functionally coupled to the lighting system 1. The cable 103 may also functionally be coupled to electronics 300. For instance, the method may also comprise introducing electronics 300 in at least part of the remainder of the starting duct 1220, and functionally coupling the electronics 300 with the lighting unit 100.

Note that the support part 210 is not necessarily configured at an end of the starting duct 1220. In other embodiments, the support part 210 may also be created such that at both sides of the support part 210 there is a first duct 220. In such embodiments, there may thus also be two transition parts 230, each between the first duct 220 and the support part 210 at each side of the support 210. Further, a plurality of support parts may be provided by deformation(s) of the starting duct 1220.

FIGS. 2*a*-2*f* schematically depict a non-limiting number of embodiments and variants.

Figure 2A:
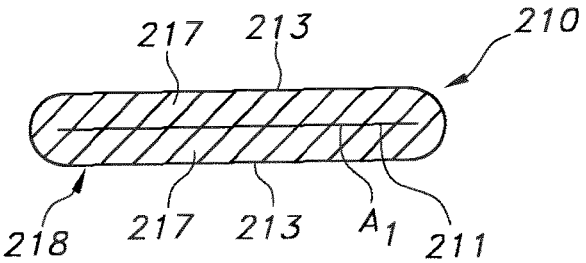
FIGS. 2*a*-2*f* schematically depict a non-limiting number of embodiments and variants.
Figure 2B:
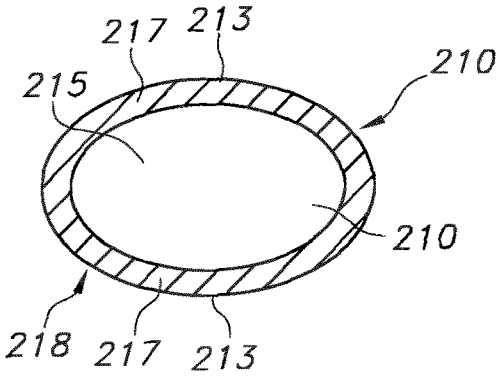
Figure 2C:
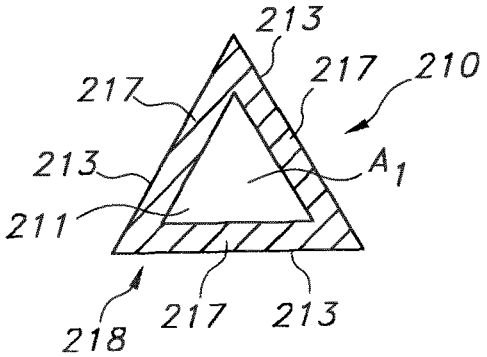

FIGS. 2*a*-2*c* schematically depict cross-sectional views of a non-limiting number of support parts 210.

In FIG. 2*a* the pinching was essentially complete, leading to an embodiment of the support part 210 comprises two wall parts 217 of the wall 218 (of the starting duct), wherein the wall parts 217 are configured essentially parallel and touch each other. Hence, there is essentially no support part channel 211; the first cross-sectional area A1 is essentially zero (square centimeter).

Both FIGS. 2*a*-2*b* schematically shows two (parallel) flat faces 213 which may support lighting units 100 (not shown).

Figure 2D:
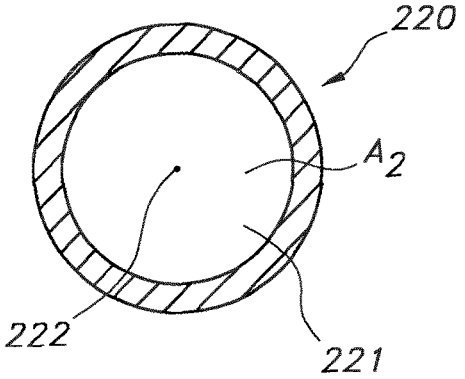

FIGS. 2*b* and 2*c* schematically depict embodiments wherein the support part 210 includes the support part channel 211 with a ratio of the first cross-sectional area A1/A2>0 (A2 is not shown in this schematic, but see e.g. FIG. 2*d*). By way of example, the support part channel 211 in the embodiment of FIG. 2*b* is filled with a thermally conductive material 215 (but this might also apply to other embodiments wherein A1/A2>0 (but A1/A2≤0.8).

By way of example, FIG. 2*c* schematically depicts a support element 210 having a triangular cross-sectional shape. This may provide three flat faces 213. Of course, other embodiments, like square, may also be possible. Hence, in embodiments the support element 210 includes multiple light source flattened areas. This may enable a better light distribution because multiple areas allow lighting in different directions.

FIG. 2*d* schematically depicts a cross-section view of the first duct 220. Note that for all embodiments 2*a*-2*c*, the duct 220 may have an essentially circular shape. However, for one or more of these, the cross-sectional shape of the first duct 220 may also be square or hexagonal. Such embodiments are herein not further depicted.

Figure 2E:
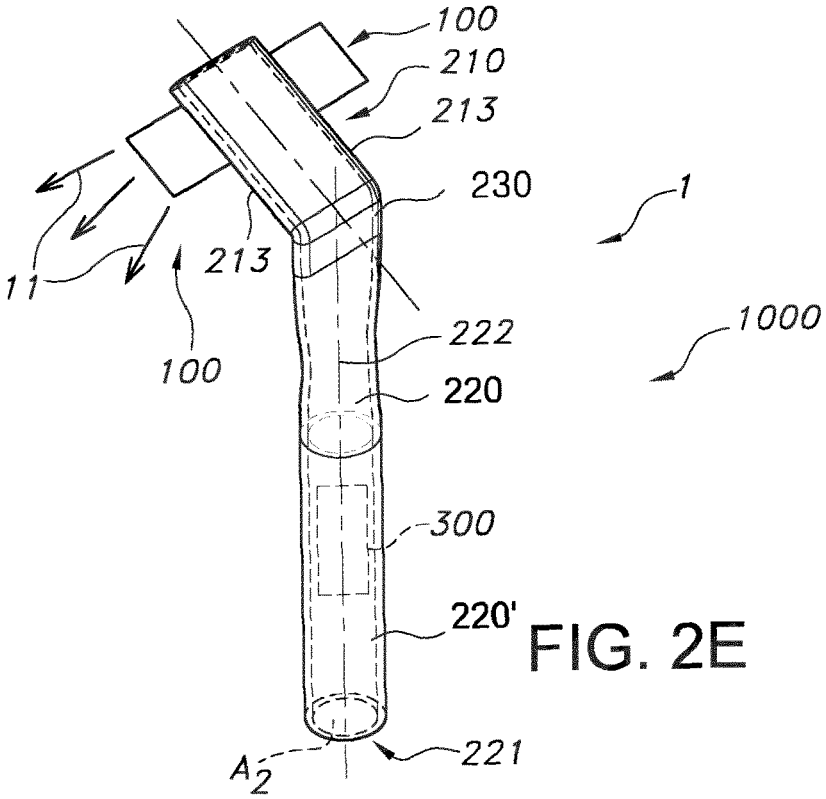

FIG. 2*e* very schematically depicts an embodiment of a pole 1000 comprising the lighting system 1 as described herein. Further, in contrast to the embodiment schematically depicted in FIG. 1, here the duct channel 221 has a channel axis 222, wherein the support part 210 and the channel axis 222 are configured non-parallel. The second cross-sectional area may especially be defined perpendicular to a duct channel axis. The first cross-sectional area may especially be defined relative to a plane, especially a flat face 213, of the support part to which the lighting unit may be associated. The cross-sectional area may be perpendicular to such flat face 213, see e.g. also FIG. 2*b*. The pole 1000 or luminaire may comprise a luminaire pole 220' or second duct 220'. As indicated in FIG. 2*e* the support part 210 comprises a flat face 213 for supporting the lighting unit 100, wherein the lighting unit 100 is arranged on the outer surface of a flattened area. As indicated in FIG. 2*e*, the lighting unit is asymmetrically arranged with respect to the channel axis. A luminaire such as for example a street light may comprise the lighting system 1.

Figure 2F:
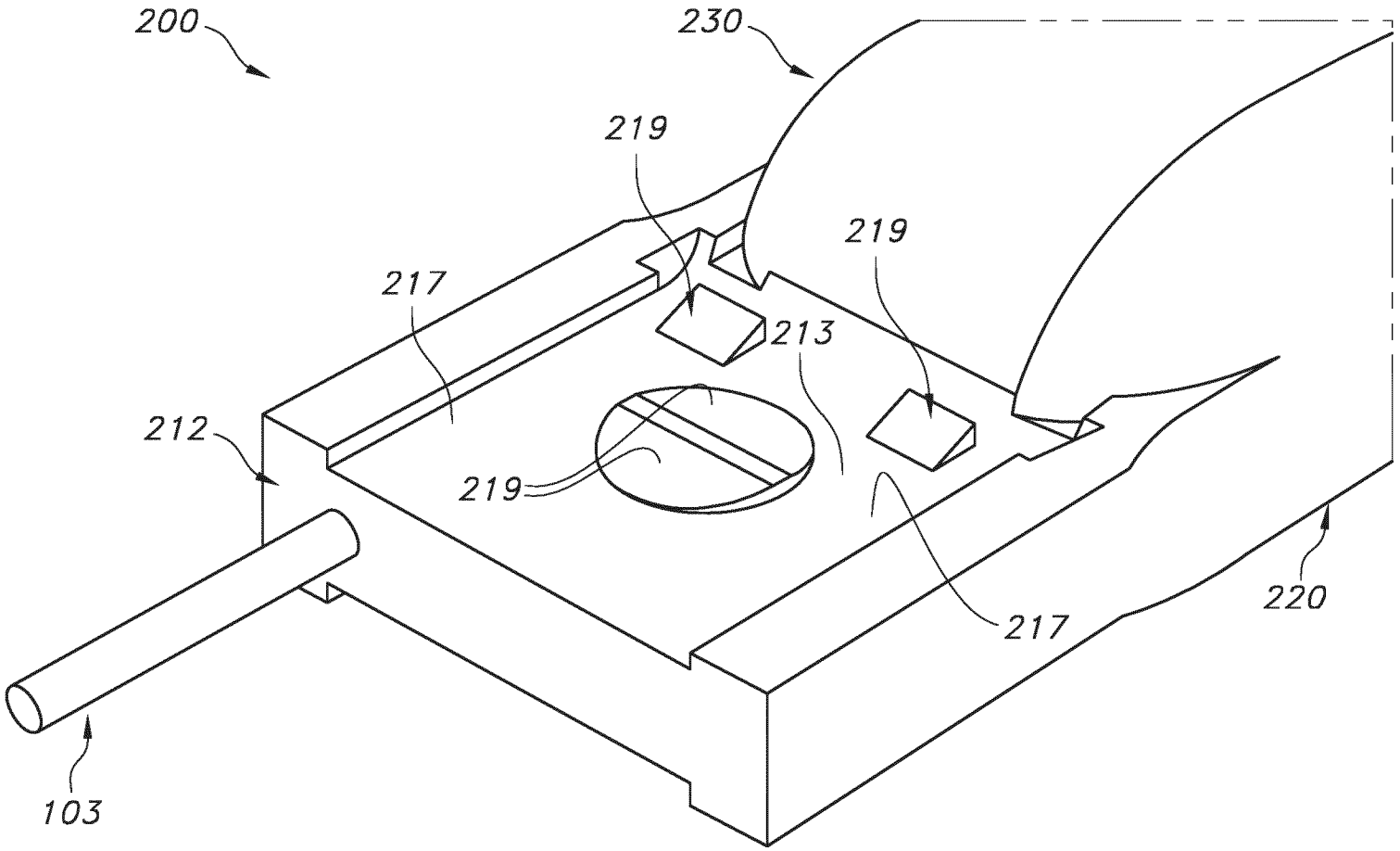

FIG. 2*f* schematically shows a further embodiment. Here, the method that led to this support element 200 included providing a channel for an electrical cable 103 as well as providing features 219 to the support part 210. Such features may include elements facilitating functional coupling of the lighting unit (cap) to the support part. Other features than shows, such as holes, may also be provided.

The term "plurality" refers to two or more. The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to". The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A lighting system comprising a lighting unit and a monolithic support element, formed from a monolithic starting duct, for supporting the lighting unit, wherein the monolithic support element comprises:

a support part for supporting the lighting unit, wherein the support part has a first length (L1), wherein the support part has a support part outer shape and support part outer dimensions, wherein the support part optionally includes a support part channel over at least part of the first length (L1) having a first cross-sectional area (A1);

a first duct having second length (L2), wherein the first duct has a first duct outer shape and first duct outer dimensions, wherein the first duct comprises a duct channel over at least part of the second length (L2) having a second cross-sectional area (A2);

a transition part bridging the support part and the first duct; wherein one or more of (i) the support part outer shape and the first duct outer shape differ, and (ii) the support part outer dimensions and the first duct outer dimensions differ;

wherein the first duct comprises electronics functionally coupled with the lighting unit; and wherein the transition part comprises a cable transit for transit of an electrical cable for a functional coupling to the lighting unit.

2. The lighting system according to claim 1, wherein, when the support part comprises the support element channel, then a ratio of the first cross- sectional area (A1) to the second cross-sectional area (A2) is equal to or smaller than 0.5, and wherein the transition part defines a gradual change from the first duct outer shape to the support part outer shape.

3. The lighting system according to claim 1, wherein the support part comprises a compressed part of the monolithic starting duct.

4. The lighting system according to claim 1, wherein the duct channel has a channel axis, wherein the support part and the channel axis are configured parallel.

5. The lighting system according to claim 1, wherein the duct channel has a channel axis, wherein the support part and the channel axis are configured non-parallel.

6. The lighting system according to claim 1, wherein the support part comprises a flat face for supporting the lighting unit, and wherein the first duct outer shape is circular.

7. The lighting system according to claim 1, wherein (i) when the support part includes the support part channel over at least part of the first length (L1), then the support part channel is filled with a thermally conductive material, or (ii) the support part comprises two wall parts of a wall, wherein the wall parts are configured parallel and touch each other.

8. The lighting system according to claim 1, wherein the monolithic support element comprises a metal.

9. The lighting system according to claim 1, wherein the support part comprises a flat face for supporting the lighting unit, wherein the lighting unit is arranged on the outer surface of a flattened area.

10. The lighting system according to claim 1, wherein the lighting unit is asymmetrically arranged with respect to a channel axis.

11. A method of making a lighting system, the method comprising:

providing a monolithic starting duct having a third length (L3), wherein the starting duct comprises a duct channel over at least part of the third length (L3) having a second cross-sectional area (A2), and deforming the starting duct over part of the third length (L3), thereby providing a support part and a transition part bridging the support part and the remainder of the starting duct, wherein one or more of (i) a support part outer shape and a first duct outer shape differ, and (ii) support part outer dimensions and first duct outer dimensions differ;

providing a cable transit in the transition part for transit of an electrical cable for a functional coupling to a lighting unit;

coupling the lighting unit to the support part; and further comprising introducing electronics in at least part of the remainder of the starting duct, and functionally coupling the electronics with the lighting unit.

12. The method according to claim 11, wherein deforming comprises compressing the starting duct over part of the third length (L3) together, until over part of the third length (L3) the duct channel has a cross-sectional area (A1) in compliance with a ratio of the first cross-sectional area (A1) to the second cross-sectional area (A2) of $0 \leq A1/A2 \leq 0.5$.

13. The method according to claim 11, further comprising creating a cable transit in the transition part, guiding an electrical cable through the cable transit, wherein the electrical cable is functionally coupled to the lighting system.

14. The method according to claim 11, wherein the starting duct comprises a metal, wherein the support part comprises a flat face for supporting the lighting unit, and wherein the first duct outer shape is circular.

15. A pole comprising the lighting system according to claim 1.

16. The lighting system according to claim 1, wherein the transition part defines a gradual change from the first duct outer shape to the support part outer shape.

17. The lighting system according to claim 1, wherein the monolithic support element is composed of material without having joints or seams.

* * * * *